US005582090A

United States Patent [19]

Pöschl

[11] Patent Number: 5,582,090

[45] Date of Patent: Dec. 10, 1996

[54] RADIAL PISTON PUMP WITH ROTARY EXPANSIBLE CHAMBER STAGE

[75] Inventor: Günter Pöschl, Schwaikheim, Germany

[73] Assignee: PPV Verwaltungs-AG, Zurich, Switzerland

[21] Appl. No.: 998,268

[22] Filed: Sep. 28, 1992

Related U.S. Application Data

[62] Division of Ser. No. 449,902, filed as PCT/EP89/00459 Apr. 26, 1989, Pat. No. 5,237,907.

[30] Foreign Application Priority Data

Apr. 27, 1988 [DE] Germany ..... 38 14 269.4

[51] Int. Cl.[6] ..... F04B 23/10; F04B 49/12

[52] U.S. Cl. ..... 91/197; 91/216 R; 417/199.1; 417/218; 417/462

[58] Field of Search ..... 417/219, 221, 417/462, 521, 199.1; 91/197, 216 R

[56] References Cited

U.S. PATENT DOCUMENTS

| | | | |
|---|---|---|---|
| 2,366,186 | 1/1945 | Freeman . | |
| 2,568,357 | 9/1951 | Monlden | 417/221 |
| 2,680,412 | 6/1954 | Entwistle | 417/221 |
| 2,683,422 | 7/1954 | Richards . | |
| 3,991,728 | 11/1976 | Vittert . | |

FOREIGN PATENT DOCUMENTS

| | | | |
|---|---|---|---|
| 257122 | 3/1988 | European Pat. Off. . | |
| 757086 | 6/1933 | France | 417/462 |
| 1653436 | 5/1971 | Germany . | |
| 2515229 | 11/1975 | Germany . | |
| 2744591 | 4/1979 | Germany . | |
| 3709389 | 10/1987 | Germany . | |
| 162079 | 8/1985 | Japan | 417/462 |
| 61-207801 | 9/1986 | Japan . | |
| 7315 | of 1914 | United Kingdom | 417/462 |
| 983135 | 2/1965 | United Kingdom | 417/462 |

*Primary Examiner*—Timothy S. Thorpe
*Assistant Examiner*—Roland G. McAndrews, Jr.
*Attorney, Agent, or Firm*—William H. Eilberg

[57] ABSTRACT

A piston machine has two pistons which reciprocate in two cylinders. The cylinders define working chambers in which a working medium can either be compressed by the pistons or can exert pressure on the pistons. The pistons are connected to a crankshaft via two connecting rods which are pivotally connected to the same crank pin. The interior of the crankcase forms a third working chamber. The crankshaft is formed as a rotary slide valve which, in operation, connects the first working chamber to the third working chamber and the second working chamber to a working medium supply or discharge opening. The piston machine can be used either as an engine (such as an expansion motor driven by compressed gas) or as a working machine (such as a machine which produces compressed gas). In another embodiment, the rotary slide valve has a rotor which is formed by the crankcase and a stator which is a ring housing. In another embodiment, the crankshaft is eccentrically secured so that a crescent-shaped intermediate space is formed between the stator and rotor, and the head portions of the cylinder liners have working faces which are alternately subjected to working medium pressure in the crescent-shaped intermediate space.

7 Claims, 7 Drawing Sheets

RADIAL PISTON PUMP WITH ROTARY EXPANSIBLE CHAMBER STAGE

This application is a divisional application of U.S. application Ser. No. 07/449,902, filed as PCT/EP89/00459 Apr. 26, 1989 now U.S. Pat. 5,237,907.

BACKGROUND OF THE INVENTION

This invention relates to a piston machine which can operate either as an engine or as a compressor.

An example of a piston machine of the prior art, in which the working medium can be conducted through the crankcase, is a two-stroke radial engine. The starting point of the invention is not, however, the provision of an improved internal combustion engine. The objective is rather to provide an improved working machine which can also be used as an engine.

A known example of such a working machine is a reciprocating piston compressor. The latter device cannot, however, be operated as a working machine without having to make extensive structural modifications to the overall construction of the compressor. Furthermore, compressors usually operate with a valve control. A valve control is prone to wear and, due to the masses moved, permits only limited speeds of rotation. Moreover, all known working machines operating with a valve control have a dead space, inherent in their construction, wherever valves or valve plates seal the piston working chamber, and the machines are inherently designed so that they act as check valves. The dead or waste space reduces the efficiency of the machine because the working medium compressed therein always remains in the working chamber, i.e. the chamber is never completely emptied. Clearly, the latter problem reduces the efficiency of the machine.

Reciprocating piston compressors, which today are used in refrigeration equipment, have the disadvantage that great damage is caused if liquid forms in the refrigerant and enters the compressor. Usually, the action of the liquid damages the valve plates. To avoid this and other disadvantages, the practice is now to use plate compressors, i.e. compressors operating only by the displacement principle. However, these also have disadvantages, i.e. greater wear at the discs due to strong area pressure between the discs and the housing inner wall at the sealing points. Furthermore, swashplate compressors have already been used but these have the disadvantage that high frictional losses occur therein and this also leads to poor efficiency.

All rotary piston working machines operating by the displacement principle can also be operated as engines. It is, for example, known to cause disc compressors to operate as disc motors (e.g. in pneumatic tools, as drive motors). However, the disadvantages which such machines have as working machines are still present when they operate as engines or prime movers. Moreover, such engines have a very high consumption of working medium, and for this reason, they also have poor efficiency.

Finally, the piston machines of the prior art have poor size/power ratios.

SUMMARY OF THE INVENTION

The present invention has the object of improving considerably the efficiency of a piston machine, by providing a machine having simpler construction and more compact overall size, as well as a greatly reduced rate of consumption of the working medium.

In the piston machine of the present invention, the interior of the crankcase is used as a third working chamber. The working medium which has been compressed or expanded in one of the two piston working chambers can therefore also do work in the third working chamber. In the third working chamber, there is formed an oscillating column of the working medium, which presses against the inner sides of both pistons. This column of the working medium generates pressure, at the piston connected to one working medium opening. Such pressure does not occur at this point in conventional piston machines. The connecting rod system, which consists of the two connecting rods, and which bends and extends at its articulation point to the crank pin, generates the oscillating working medium column, and permits the aforementioned utilization of the additional pressure.

When the piston machine is operated as an engine (for example, as an expansion motor operated with compressed gas), such additional pressure is added to the pressure generated in the working chamber of the other piston by expansion of the working medium. When the piston machine of the present invention is operated as a working machine (for example, as a compressor), the working medium compressed in one or the other of the working chambers associated with the respective pistons is subsequently conducted into the third working chamber where its pressure assists the one piston in the next compression stroke thereof, and at the same time, by the extension or stretching of the connecting rod system, supports the other piston in its induction stroke, so that, in this case, the additional relieving by the pressure in the third working chamber leads to the desired improvement in efficiency. The compressed gas passes through the third working chamber and out of the machine.

The slide valve means used in the piston machine of the present invention is not directly associated with the first and second working chamber so that dead spaces are avoided in the latter. The opening and closing times can be controlled substantially more exactly than by means of the check valves used in the prior art because the latter valves can be caused to open by resonance vibrations.

The consumption of working medium in the piston machine of the present invention is considerably less than in the prior art because, for the same power, less working medium is required, since additional energy is drawn from the third working chamber. Since to produce the same power, less working medium is required, as compared with the prior art, the first and second working chambers can be made correspondingly smaller. This gives a substantially more compact overall size of the piston machine or engine according to the present invention, for the same power.

In a further embodiment of the invention, the slide valve means has a very simple construction and nevertheless insures a very exact control. The number of individual parts is small, not only because the crankshaft itself forms the rotary slide valve but also because the only moving parts are the crank pin and the two connecting rods with their pistons and piston pins.

In a further embodiment, the piston machine forms an outer rotor. In this embodiment, the piston machine runs very silently because the only masses moved by it are the oscillating pistons. The revolving rotor has a large mass and accordingly stores a large amount of energy which promotes the quiet operation of the piston machine.

In a further embodiment, the displaceable cylinder liners provide, with their head portions, a good low-wear seal. If the pressure between the piston and stator exceeds a predetermined value, for example because, on compression, a liquid is present, the cylinder liner can yield inwardly and thus help to relieve pressure. If a known high-pressure compressor is stationary for a relatively long time, then experience has shown that condensate forms in the working chamber of the piston which is at the lower deadcenter. On starting up the high-pressure compressor, this almost always leads to the valve plates being broken (due to the aforementioned liquid shock). When the piston machine according to the invention is used as a high-pressure compressor, this danger is eliminated because, at the start of operation, the cylinder liners do not yet bear with high pressure on the inner wall of the stator and therefore readily allow condensate to escape into the third chamber. Such condensate then leaves the third chamber with the working medium.

In a further embodiment, check valves are provided for use with some working media which tend to leak because of their low density. The control openings have a peripheral spacing which is equal to the arc length of the working chamber at the stator inner periphery. As a result, a good seal is achieved between the head portion of each cylinder liner, and the housing need not perform any sealing function in the region outside the head portion.

In a further embodiment, a crescent-shaped intermediate chamber is provided as a fourth working chamber, subdivided by the head portion of the cylinder liner. Working medium which is compressed or made to expand in the first or second working chamber will insure additional pressure or relief in the crescent-shaped intermediate chamber at the tangential working faces.

In a further embodiment, the rotational setting of the crankshaft can be achieved, for example, by means of the refrigerant pressure in a refrigeration apparatus, in accordance with the power. With increasing pressure of the working medium, which pressure acts on the rack, the position of the crank pin is changed so that, for example, the filling time increases. In this manner, according to the invention, the displacement of the piston machine used as a refrigerant compressor can be adapted automatically to the refrigeration requirement.

In a further embodiment, the wear region of the piston machine consists of ceramic.

If the piston machine of the present invention is used as an engine, it is very suitable for use as a refrigerant compressor, as it does not need any oil lubrication. The facts that the piston machine of the present invention is provided with a slide valve means instead of valves, and, as explained above, that it does not have any dead space, are further factors which make this machine ideally suited for use as a refrigerant compressor. The slide valve control does not have any reciprocating parts, and is therefore considerably less prone to wear than valves. Because the machine does not have dead space, the first and second working chambers can always be completely emptied. Moreover, the working medium in the chambers can always be completely compressed.

In a further embodiment, one can construct a piston machine assembly, having any desired number of cylinders, simply by connecting identical piston machines in series, in a common housing, with a common crankshaft, without having to modify the individual piston machines themselves. In this embodiment, some of the piston machines may operate as working machines and the others may operate as engines, or alternatively they may all be operated as working machines or all as engines.

DETAILED DESCRIPTION OF THE INVENTION

The piston machine illustrated in FIGS. 1–4, which can be used as a compressor (i.e. working machine) or as an expansion motor (i.e. an engine), will be described in detail hereinafter with reference to its use as a compressor, followed by a brief explanation of its use as an expansion motor.

Figure 1:
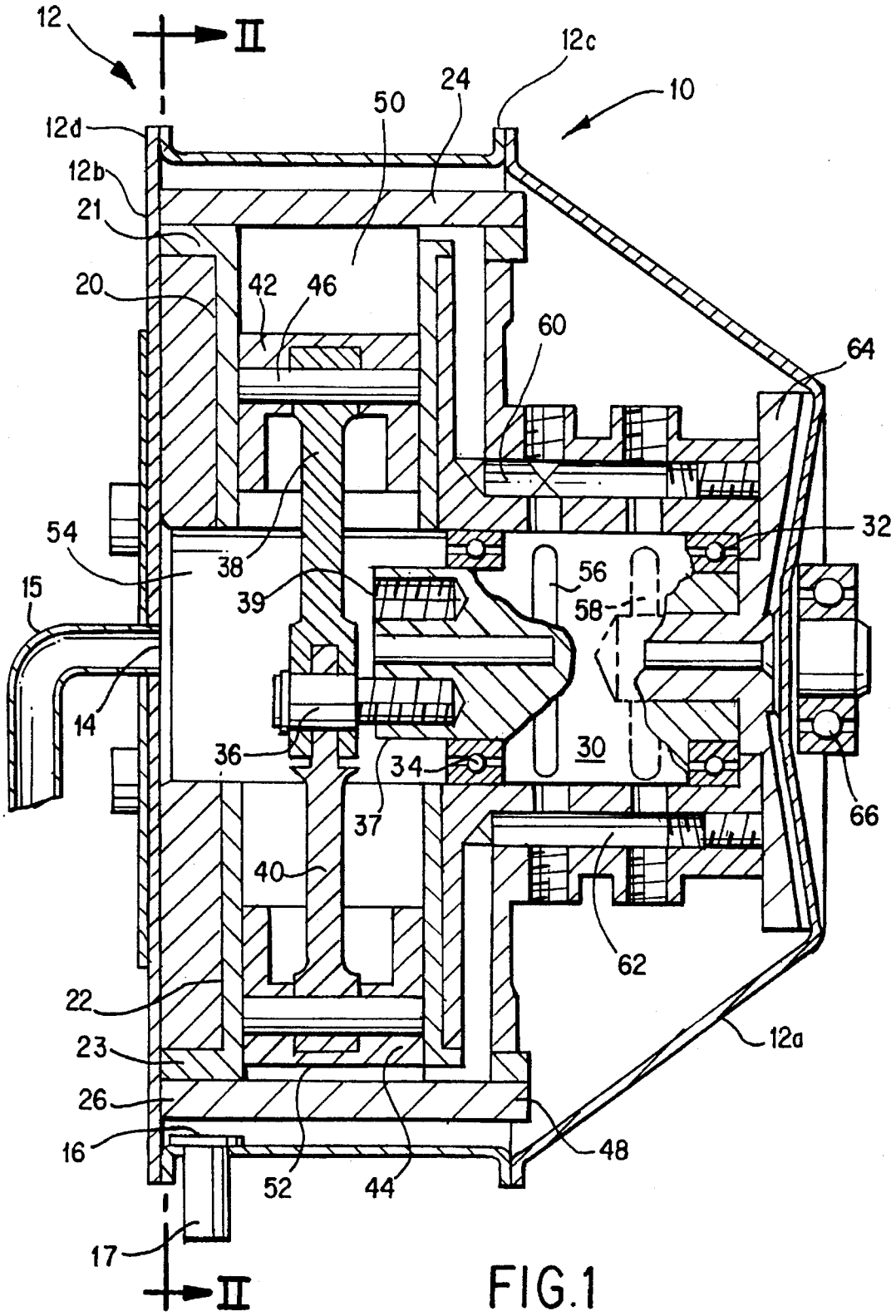
FIG. 1 is a longitudinal sectional view of a first embodiment of the piston machine according to the invention.
Figure 2:
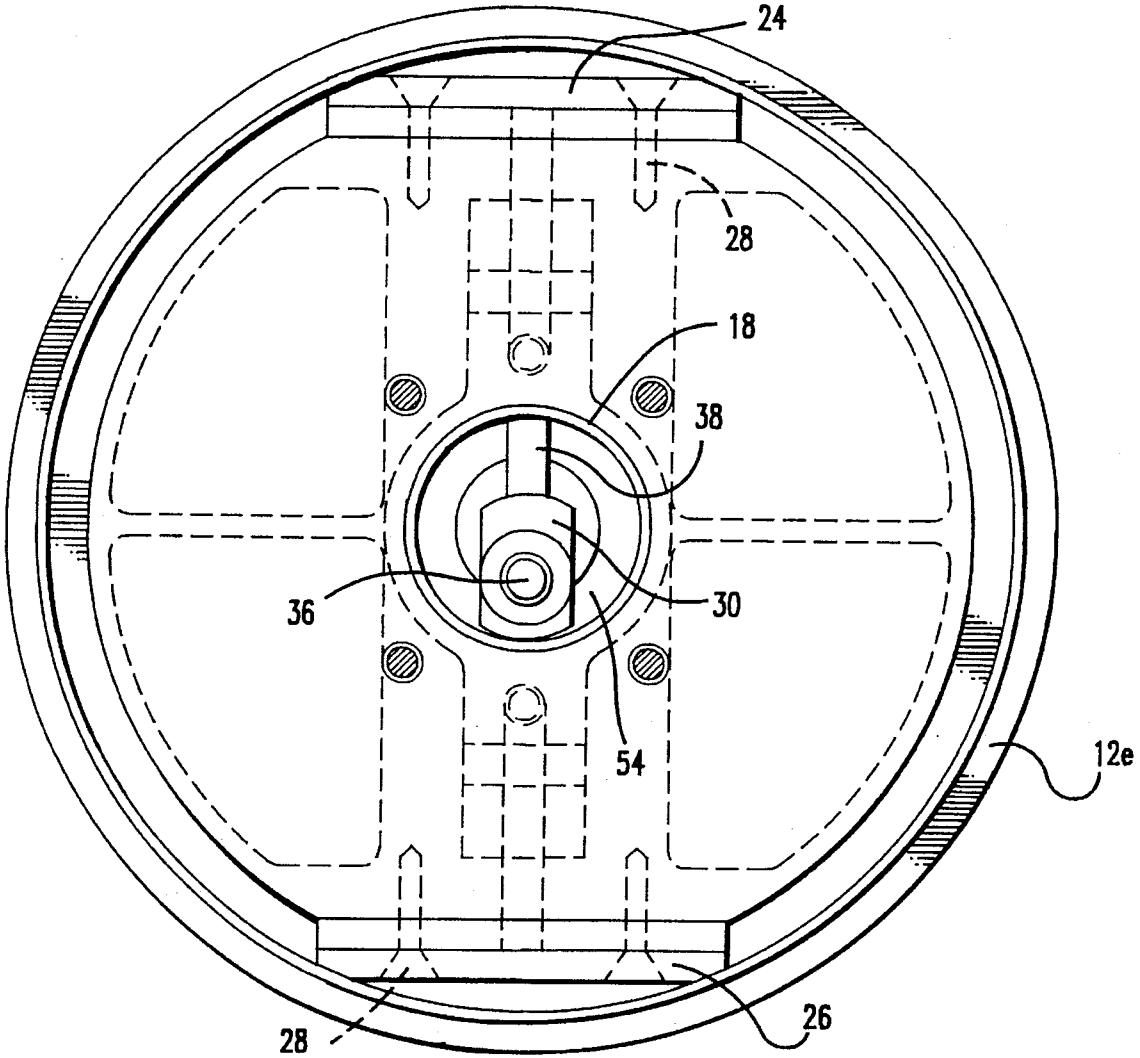
FIG. 2 is a cross-sectional view of the piston machine, taken along the line II—II of FIG. 1.

FIGS. 1 and 2 show in longitudinal section and in cross-section a first embodiment of the piston machine which is denoted as a whole by reference numeral 10. The machine comprises a ring housing 12 which is sealed by a frustoconical cover 12*a* and an annular cover 12*b* which are sealingly connected to the ring housing at flanges 12*c* and 12*d*. When the machine is used as a refrigerant compressor, this sealing connection is preferably established by hard soldering or welding. When using the piston machine as a compressor for other purposes, the sealing connection can also be established by means of screws and O-rings (not illustrated). The ring housing 12, sealed by the covers 12*a* and 12*b*, has only two working medium openings 14, 16 which are connected to working medium conduits 15 and 17, respectively.

The ring housing 12 contains a crankcase 18 on which two diametrically opposite cylinders 20, 22 are integrally formed. The cylinders each contain a cylinder liner 21 and 23, respectively. The two cylinders are each sealed on the outside by a plate 24, 26, respectively. In accordance with the illustration of FIG. 2, the plates 24, 26 are secured to the crankcase 18 by means of screws 28. It can further be seen in FIG. 2 that the crankcase 18 comprises an inner portion which is substantially cylindrical in cross-section and on which at the top and bottom the two cylinders 20 and 22, respectively, are integrally formed. The outer ends of the cylinders are connected together by arcuate portions of the crankcase which are integrally connected by diametrically opposite ribs to the cylindrical inner portion as is shown in dashed lines in FIG. 2.

According to the illustration of FIG. 1, the aforementioned portion of the crankcase, which is disposed substantially within the ring housing 12, is followed on the right by a hub-shaped portion which is disposed substantially within the frustoconical cover 12*a* and is likewise integrally formed on the rest of the crankcase 18. A crankshaft 30 is rotatably mounted by means of ball bearings 32, 34 in said hub-shaped portion of the crankcase 18. At the left end in FIG. 1, the crankshaft 30 carries a crank pin 36 to which two connecting rods 38, 40 are pivotally connected at their inner ends.

Two pistons 42, 44, displaceably arranged in the cylinders 20, 22, are rotatably connected to the outer ends of the connecting rods 38, 40 by piston pins 46, 48. The connecting rods 38, 40 and the crank pin 36 are thus part of a crank drive which connects the pistons 42, 44 to the crankshaft 30. Between each end face of the pistons 42, 44 and each opposite plate 24 and 26, respectively, a working chamber 50 and 52 is formed in which the working medium, in the case where the machine is used as a compressor, is compressed, and where, in the case where the machine is used as a motor, is expanded. The space in the crankcase 18 between the crankshaft 30 and the cover 12*c* and between the inner sides of the pistons 42, 44 forms a third working chamber 54 which is connected to the working medium conduit 15.

In the piston machine shown in FIGS. 1 and 2, the crankshaft 30 is formed as a rotary slide valve which positively controls the flow of the working medium within the piston machine 10. For this purpose, the crankshaft has two angularly offset grooves bores 56, 58. The groove 56 leads from the third working chamber 54 to a passage 60 in the crankcase wall which is connected to the working chamber 50. The groove 58 leads from a passage 62 in the crankcase wall which is connected to the working chamber 52 to the working medium opening 16. The mutual angular offsetting (in the direction of rotation of the crankshaft 30) is selected so that when the groove 56 connects the working chamber 50 to the working chamber 54 the groove 58 simultaneously or subsequently connects the working chamber 52 to the working medium opening 16.

The crank pin 36 is inserted into a blind bore 37 of the crankshaft 30. A diametrically opposite further blind bore 39 receives a balance weight, not illustrated. When the direction of rotation of the piston machine is to be reversed, the crank pin 36 is inserted into the blind bore 39 and the balance weight into the blind bore 37. At the right end, the crankshaft 30 carries an iron core 64 which is fixedly connected thereto and is part of a magnetic coupling which is otherwise not illustrated and is provided outside the outer housing 12. This part of the magnetic coupling which is not illustrated is mounted on a ball bearing 66 and is driven by an electric motor or the like which is also not illustrated. Consequently, when the magnetic coupling is energized, the iron core 64 is entrained and the crankshaft 30 thus set in rotation. In this manner, the compressor can be driven without the need for shaft passages and the like. All of the parts of the piston machine which slide on each other, and generally all the wearing parts of the piston machine, are coated with ceramic (e.g. a ceramic oxide). The piston machine therefore requires no lubrication by conventional lubricants such as oil or the like.

When the piston machine of FIGS. 1 and 2 is used as a refrigerant compressor, the machine operates in the following manner. Gas enters the machine through conduit 17 and passes through opening 16, and through the cavity shown at the bottom and bottom-right portion of FIG. 1, and continues through the interior of the outer housing 12, and enters groove 58. As explained above, grooves 56 and 58, formed in the crankshaft, are angularly offset; groove 56 is therefore shown in full, and groove 58 is shown in dotted outline. Grooves 56 and 58 connect either with passage 60 or 62, depending on the angular position of the crankshaft. However, regardless of the instantaneous connection of the grooves to the passages, groove 58 is always used to conduct gas that is being sucked in for compression, and groove 56 always conducts gas that has been compressed and is ready to be ejected from the machine.

Thus, in operation of the compressor, gas entering at conduit 17 flows into groove 58, and then through either passage 60 or 62, and into chamber 50 or 52, depending on whether groove 58 connects with passage 60 or 62, respectively. The gas is compressed in chamber 50 or 52, and then returns through the same passage (60 or 62) through which it entered the chamber. However, when the gas returns after the compression stroke, the crankshaft has truned, and the passages are now connected to opposite grooves. The compressed gas now passes through groove 56, and then into chamber 54, and out of the machine at 14 and 15. Thus, gas is compressed in one of chambers 50 or 52, while gas is being sucked in in the other of these chambers.

As illustrated, the pistons 42, 44 are connected through the connecting rods 38 and 40 to the same eccentric crank pin 36 and consequently the one piston is at the top deadcenter when the other piston is at the bottom deadcenter, and vice versa. When the refrigerant compressed in either of chambers 50 or 52 subsequently passes to the third working chamber 54, the refrigerant pressure assists one piston in its next compression stroke and simultaneously assists the other piston in the induction stroke thereof by the stretching of the connecting rod system consisting of the two connecting rods 38, 40.

When the piston machine 10, according to FIGS. 1 and 2, is operated as an engine, i.e. as an expansion motor operated with compressed gas, the latter passes through the working medium conduit 15 into the third working chamber 54, the pressure of the compressed gas thereby being added to the pressure in the working chamber of the other piston which is generated by expansion of the compressed gas in the working chamber. The piston machine can thus operate selectively as an engine or as a working machine without the need for any structural modifications. In operation as an expansion motor, through the pistons 42, 44 and the connecting rods 38, 40, the compressed gas drives the crankshaft 30 which, through the iron core 64 and the other part of the magnetic coupling, not shown, drives the electric motor (also not shown), which then operates as a generator. The simultaneous use of such piston engines as working machines and engines in a piston machine assembly will be described below with reference to FIG. 5.

Figure 3A:
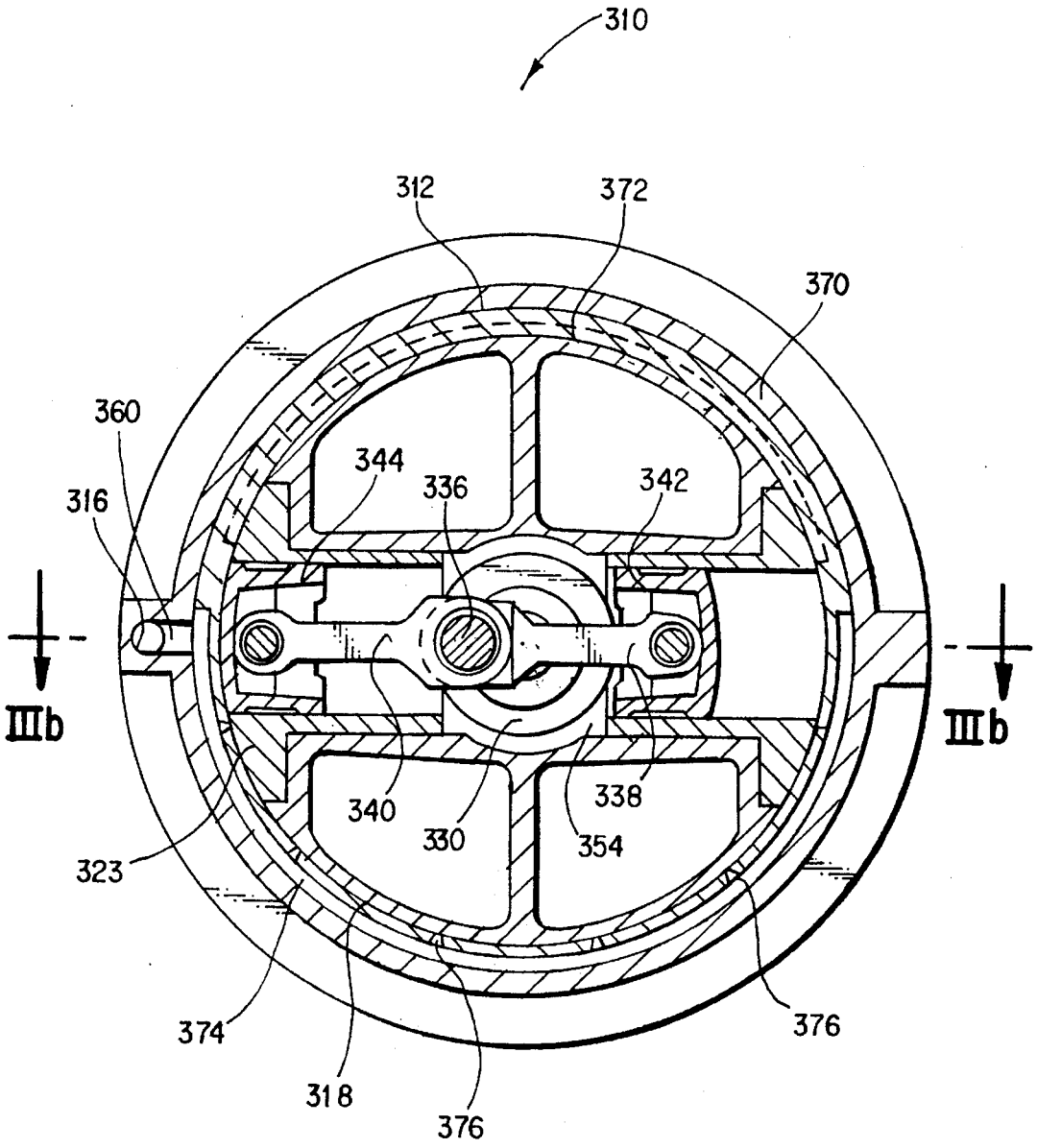
FIG. 3*a* is a cross-sectional view of a second embodiment of the piston machine according to the invention.
Figure 3B:
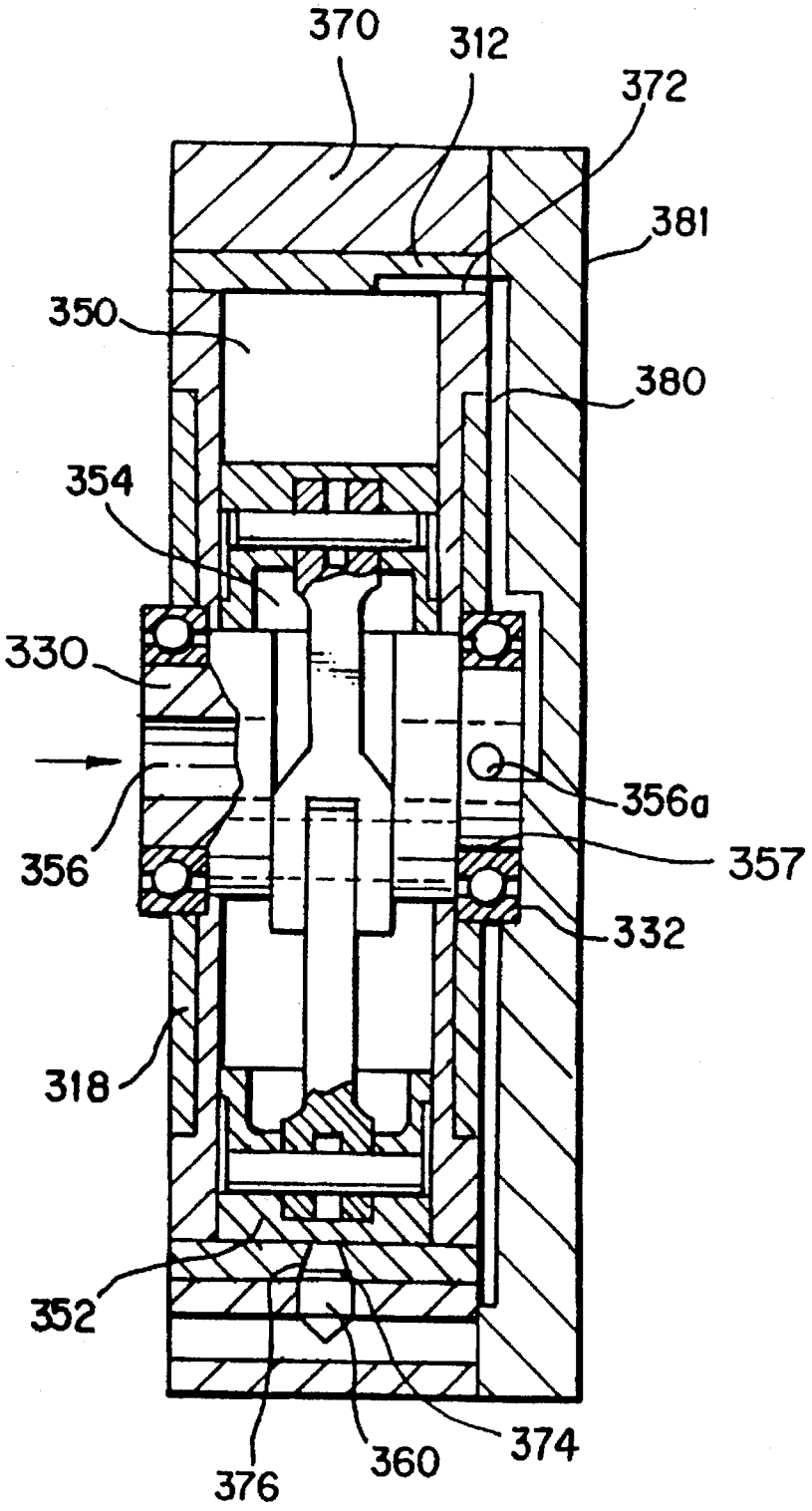
FIG. 3*b* is a longitudinal sectional view of the piston machine, taken along the line IIIb—IIIb of FIG. 3*a*.
Figure 3C:
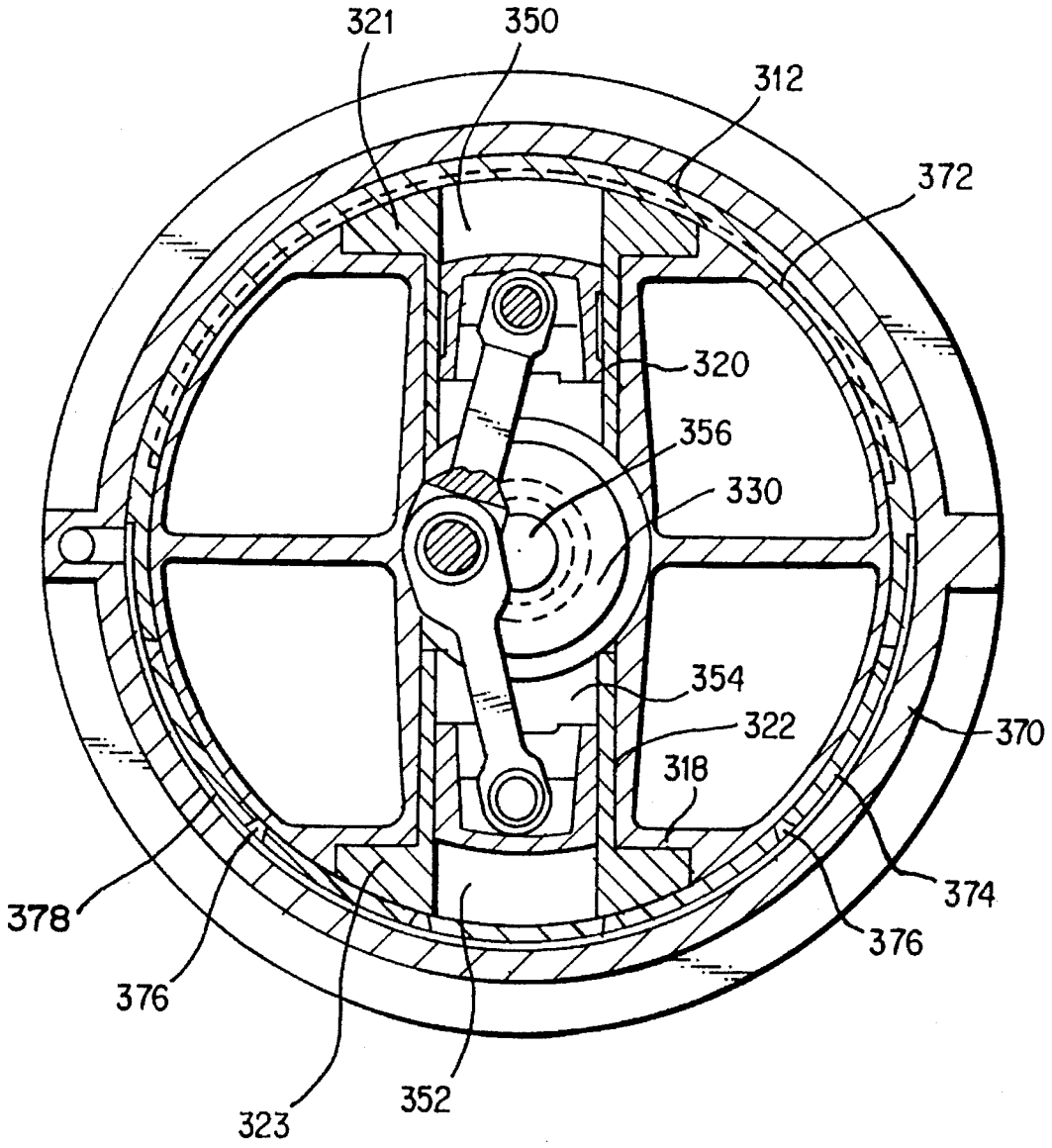
FIG. 3*c* shows the second embodiment of the piston machine of the present invention in a first position in which the crankcase is displaced through 90° with respect to the illustration of FIG. 3*a*.

In FIGS. 3*a*–3*c*, identical parts to those in FIGS. 1 and 2 bear reference numerals which have been increased by 300. FIGS. 3*a*–3*c* show a second embodiment of the piston machine, denoted as a whole by 310, in which although the slide valve means is likewise a rotary slide valve, the rotor of the rotary slide valve is formed by the crankcase 318, the stator of the rotary valve is the ring housing 312, and the crankshaft 330 is stationary. The cylinder liners 321 and 323 are made mushroom-shaped and arranged displaceably in the crankcase 318. The plates 24, 26 of the embodiment according to FIGS. 1 and 2 are not present in the embodiment according to FIGS. 3*a*14 3*c*.

The head portions of the cylinder liners 321, 323 have on the inside parallel planar faces with which they can bear on adjacent shoulders of the crankcase 318 and external cylinder faces which have the same curvature as the inner wall of the ring housing 312. The cylinder liners 321, 323 are fitted, slidably, into their cylinders 320 and 322 respectively, so that when the crankcase 318 rotates, they bear under centrifugal force against the inner wall of the ring housing 312 and seal the working chambers 350 and 352 respectively, at the end faces. The ring housing 312 forming the stator is inserted into an outer housing 370 and, as illustrated, comprises two arcuate recesses 372, 374 on the inner and outer peripheries. The recess 372 at the inner periphery is connected to the third working chamber 354 through a gap 380 which is formed between a closure cover 381 and the crankcase 318. The crankshaft 330 has a bore 356 which communicates, through a gap 357 provided adjacent the ball bearing 332, with the gap 380. The bore 356 of the crankshaft opens at the right crank cheek through an opening 356*a*, directly into the third working chamber 354. The arcuate recess 372 extends peripherally over an arc length of about 160° and axially from a point on the right of the center plane of the section of FIG. 3*b* to the inner side of the closure cover 381.

The arcuate recess 374 at the outer periphery is an outer groove which extends peripherally over an arc length of about 180° and through control openings 376 formed in the ring housing 312. The mutual peripheral spacing of the control openings 376 is greater than or equal to the arc length of each working chamber 350, 352. On the other hand, the recess 374 communicates with the working medium opening 316 in the outer housing 370 through a passage 360 formed as a bore. The control openings 376 are provided with check valves 378, adapted to be pressed up from the inside to the outside.

In the embodiment according to FIGS. 3*a*–3*c* also, all the parts which slide on each other, and generally all wearing parts, are coated with ceramic (e.g. a ceramic oxide) or are made of ceramic.

When the piston machine according to FIGS. 3*a*–3*c* is used as a refrigerant compressor, the refrigerant forming the working medium is sucked into the third working chamber 354 through the bore 356 formed in the crankshaft 330 and the opening 356*a*. From the third working chamber 354 the refrigerant passes through the gap 380 and the annular recess 372 into the working chamber 350 in which it is compressed. Simultaneously, the second working chamber 352 is separated from the third working chamber 354 due to the mutual angular offsetting of the arcuate recesses 372, 374. At this instant or later, the recess 374, through one of the control openings 376, connects the second working chamber 352 to the working medium opening 316, through which compressed refrigerant emerges. In the embodiment according to FIGS. 3*a*–3*c* also, the pistons 342, 344 are connected, as illustrated, through the connecting rods 338 and 340, respectively, to the same eccentric crank pin 336, and consequently the one piston is at the upper deadcenter when the other piston is at the lower deadcenter, and vice versa. The refrigerant compressed in the working chamber 350 of the piston 342 then passes into the third working chamber 354 where the refrigerant pressure supports the one piston in its next compression stroke and simultaneously, by the extension of the connecting rod system consisting of the two connecting rods 338, 340, assists the other piston in its induction stroke.

When the piston machine 310 according to FIGS. 3*a*–3*c* is operated as an engine, it works analogously to the piston machine according to FIGS. 1 and 2, and in this respect, the reader's attention is drawn to the description of operation given above.

Figure 4:
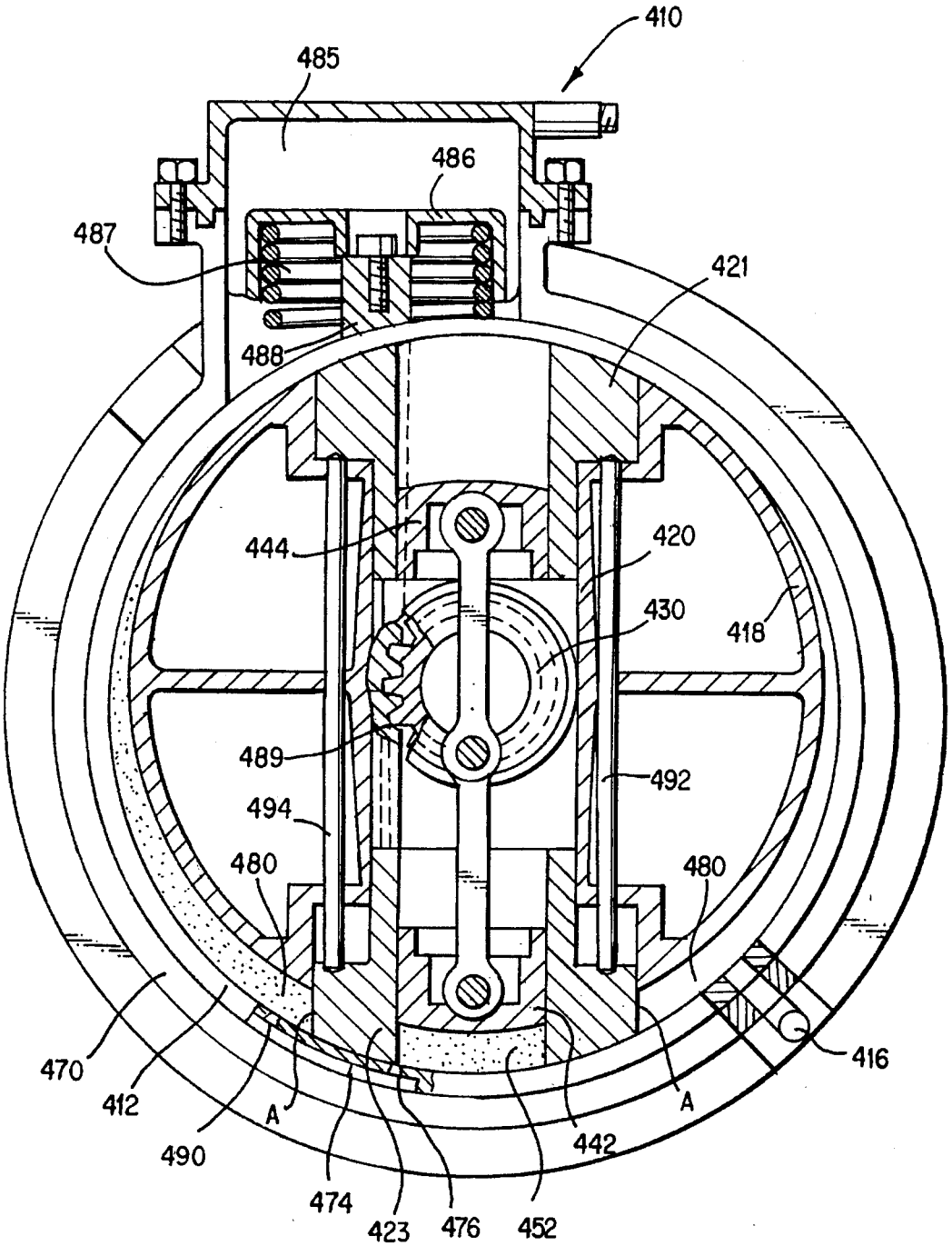
FIG. 4 is a cross-sectional view of a third embodiment of the piston machine according to the invention.

The third embodiment of the piston machine, which is illustrated in FIG. 4 and denoted as a whole by reference numeral 410, has fundamentally the same construction as the second embodiment shown in FIGS. 3*a*–3*c*. For clarity, of the two arcuate recesses, only the recess 474 has been shown in FIG. 4. Consequently, only the significant differences will be described, identical parts bearing reference numerals increased by 100 relative to the reference numerals of FIGS. 3*a*–3*c*.

The crankcase 418 has a smaller diameter than the ring housing 412. The crankshaft 430 is eccentrically mounted so that a crescent-shaped intermediate space 480 is formed between the ring housing 412 (stator) and the crankcase 418 (rotor). The head portions of the cylinder liners 421,423 have working surfaces A. In the position of the crankcase 418, illustrated in FIG. 4, the crescent-shaped intermediate space 480 is divided exactly into halves by the head of the cylinder liner 423, so that the one working area A confines the one half and the other working area A the other half of the intermediate space 480.

The outer housing 470 includes, at the top, a chamber 485 in which a rolling diaphragm piston 486 is mounted as illustrated. The space above the rolling diaphragm piston 486 is a pressure chamber which, when the piston machine is used as a refrigerant compressor, is subjected to refrigerant pressure. A helical spring 487, disposed beneath the rolling diaphragm piston 486, acts against such pressure. The cylinder liners 421 and 423 are rigidly connected together by rods 492, 494 and thus only jointly displaceable in the cylinder 420. A piston rod 488 of the rolling diaphragm piston 486 is formed as a rack which meshes with a pinion 489 non-rotatably connected to the crankshaft 430. The rack is actuated by subjecting the rolling diaphragm piston 486 to the refrigerant pressure in the chamber 485. In this manner, the crankshaft 430 is rotationally adjustable.

The piston machine is shown in FIG. 4 in the center position which applies for normal pressure. When the refrigerant pressure in the chamber 485 increases, the crankshaft 430 is turned and the control time is thus changed, so that the working chamber, over one of the two pistons 442, 444, into which the working medium is sucked, is no longer completely filled. As a result, the displacement drops accordingly. As a result, the refrigerant pressure in the chamber 485, in turn, drops so that the crankshaft is again turned in the direction of its illustrated position, which applies in the case of normal pressure. When pressure drops in the chamber 485, the opposite occurs.

In the piston engine according to FIG. 4, the crescent-shaped intermediate space 480 serves as a fourth working chamber. In each case, only one of the two parts of the intermediate chamber face the working faces A. An overflow bore 490, which is formed in the ring housing 412 at the point illustrated in FIG. 4, communicates through the arcuate recess 474 at the outer periphery of the ring housing 412 with the working chamber 452, through one of the control openings 476. When the cylinder lining 423 has reached its position shown in FIG. 4, the refrigerant compressed in the working chamber 452 passes along the path described above into the part of the intermediate space 480 on the left in FIG. 4. In this case, the crankcase turns counterclockwise in Figure 4. The compressed refrigerant gas now expands in this part of the intermediate space 480 and drives the cylinder liner 423 additionally by acting on the left working area A thereof until the working chamber 452 comes into connection with the working medium 416 which leads outwardly, and through which said part of the crescent-shaped intermediate space 480 is then evacuated. The head of the cylinder liner 421 assists the expulsion of the refrigerant through the working medium opening 416.

Figure 5:
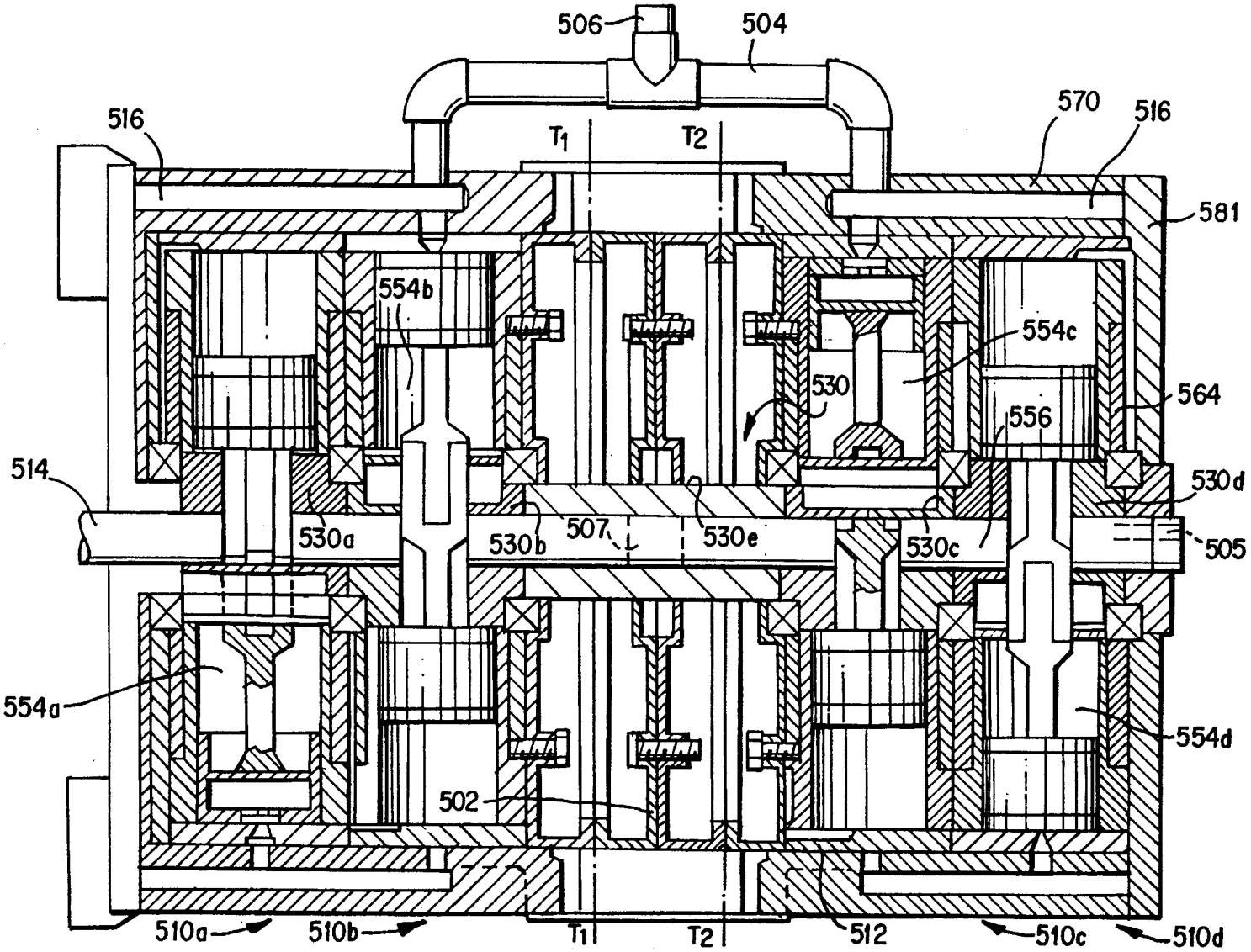
FIG. 5 shows a piston machine assembly which comprises a plurality of piston machines according to FIG. 3 arranged in series with a common crankshaft.

FIG. 5 shows the use of four piston machines 510*a*–510*d* in a common outer housing 570 and having a common crankshaft 530. The crankshaft 530 consists of segments 530*a*–530*e* which are screwed together. Between the piston machine pair 510*a*, 510*b*, on the one hand, and the piston machine pair 510*c*, 510*d* on the other hand, a magnetic coupling 502 is disposed. The piston machines 510*a*–510*d* have the same construction as the piston machine 310 shown in FIGS. 3*a*–3*c*. The piston machine pair 510*a*, 510*b* acts on the same working medium 516. The same applies to the piston machine pair 510*c*, 510*d*. The working medium opening 516 of the one pair is connected to that of the other pair through an overflow line 504 and both the working medium openings 516 are formed as ring passages passing peripherally through the outer housing 570. The third working chambers 554*a*–554*d* of the piston machines are connected together through a bore 556 passing through the crankshaft 530 over its entire length. At the left end, the bore 556 is connected to the working medium opening 514 and at the other end it is sealed by a plug 505. The magnetic coupling 502 has two separating planes T1, T2 indicated by a dot-dash line. When the magnetic coupling is not energized, the left and the right piston machine pair can be operated independently of each other, each as an expansion motor or as a compressor. When the left piston machine pair operates as an expansion motor, the right piston machine pair can be selectively connected by energizing the magnetic coupling. The same applies when the left piston machine pair is operated as a compressor, when the right piston machine pair can be connected as a further compressor. The overflow line 504 is connected to a manifold line through a connection 506. When all the piston machines are operating as compressors, working medium is sucked in through the working medium opening 514 and compressed working medium is discharged through the connection 506. When all the piston machines operate as expansion motors, compressed gas is supplied through the connection 506 and then emerges through the working medium opening 514.

When one piston machine pair is operated as an expansion motor, and the other piston machine pair is operated as a compressor, the overflow line 504 is blocked (e.g. by a slide valve, not shown). Likewise, the bore 556 in the crankshaft 530 is blocked in the region between the two separating planes T1 and T2 (e.g. by a plug 507 indicated by a dashed line). The two piston machine pairs then operate independently of each other in the manner described above with reference to FIGS. 3*a*–3*c*.

If, for example, the right piston machine pair 510*c*, 510*d* is operated as a working machine, i.e. as a compressor, besides the closure cover 591 as in the embodiment of FIG. 1, a further magnetic coupling (not shown) is provided which is equipped with a rotary drive and which, through the closure cover 581, entrains an iron core 564 which is non-rotatably connected to the crankcase 518. In FIG. 5, for simplicity, instead of providing a separate iron core 564, at least the right portion of the crankcase 518 is made of iron.

I claim:

1. Piston machine, which operates either as an engine or as a working machine, the piston machine comprising:

two pistons connected via connecting rods to a single eccentric crank pin of a crankshaft, the pistons forming first and second working chambers in two cylinders, arranged 180° apart so that when one piston is at top deadcenter the other is at bottom deadcenter, said crank pin and connecting rod assembly being located in a crankcase, the machine further comprising a slide valve and control passages through which a working medium is conducted to and from the first and second working chambers, wherein the slide valve and control passages are so arranged that the working medium, at high pressure, passes through the crankcase regardless of whether the piston machine is operated as an engine or as a working machine, wherein the crankcase acts as a third working chamber by virtue of the pressure from the working medium acting on the underside of the pistons, wherein the slide valve is a rotary slide valve of which a rotor is formed by the crankcase and a stator is a ring housing, wherein the crankshaft is stationary in operation, the piston machine further comprising cylinder liners which are slidably arranged in the crankcase and surround the first and second working chambers respectively and which for end-side sealing bear with their head portion on the inner wall-of the ring housing, wherein the crankshaft is eccentrically secured so that a crescent-shaped intermediate space is formed between the stator and rotor and that the head portions of the cylinder liners have working faces which in the crescent-shaped intermediate space are alternately subjectable to working medium pressure.

2. The piston machine of claim 1, wherein the crankshaft is rotationally adjustable.

3. The piston machine of claim 2, wherein for rotational adjustment of the crankshaft a rack is provided which meshes with a pinion non-rotatably connected to the crankshaft.

4. The piston machine of claim 3, wherein the rack is actuatable by subjecting it to the action of the working medium.

5. The piston machine of claim 2, wherein the two cylinder liners are rigidly connected together.

6. The piston machine of claim 5, wherein for rotational adjustment of the crankshaft a rack is provided which meshes with a pinion non-rotatably connected to the crankshaft.

7. The piston machine of claim 6, wherein the rack is actuatable by subjecting it to the action of the working medium.

* * * * *